US009243216B2

(12) United States Patent
Miralles

(10) Patent No.: US 9,243,216 B2
(45) **Date of Patent: *Jan. 26, 2016**

(54) USE OF A STARCH BASE COPOLYMER IN CONJUNCTION WITH A MALEIC POLYMER AND A HYDROXYPOLYCARBOXYLIC ACID TO CONTROL HARDNESS UNDER ALKALINE CONDITIONS

(71) Applicant: Ecolab USA Inc., St. Paul, MN (US)

(72) Inventor: Altony J. Miralles, Woodbury, MN (US)

(73) Assignee: Ecolab USA, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/479,436

(22) Filed: Sep. 8, 2014

(65) Prior Publication Data

US 2014/0378364 A1 Dec. 25, 2014

Related U.S. Application Data

(63) Continuation of application No. 13/662,676, filed on Oct. 29, 2012, now Pat. No. 8,901,057.

(51) Int. Cl.

| | |
|---|---|
| ***C11D 7/26*** | (2006.01) |
| ***C11D 3/20*** | (2006.01) |
| ***C11D 3/22*** | (2006.01) |
| ***C11D 3/37*** | (2006.01) |

(52) U.S. Cl.

CPC ..... *C11D 7/265* (2013.01); *C11D 3/2086* (2013.01); *C11D 3/222* (2013.01); *C11D 3/3757* (2013.01); *C11D 7/268* (2013.01)

(58) Field of Classification Search

CPC ..... C11D 3/22; C11D 3/3757; C11D 3/2086; C11D 7/265

See application file for complete search history.

(56) References Cited

U.S. PATENT DOCUMENTS

| | | | | |
|---|---|---|---|---|
| 2007/0015678 | A1 | 1/2007 | Rodrigues et al. | |
| 2007/0021577 | A1 | 1/2007 | Rodrigues et al. | |
| 2008/0020961 | A1 | 1/2008 | Rodrigues et al. | |
| 2008/0021168 | A1 | 1/2008 | Rodrigues et al. | |
| 2009/0102085 | A1* | 4/2009 | Stolte et al. | 264/71 |
| 2010/0069280 | A1 | 3/2010 | Rodrigues et al. | |

FOREIGN PATENT DOCUMENTS

| | | |
|---|---|---|
| GB | 1322536 | 7/1970 |

* cited by examiner

*Primary Examiner* — Necholus Ogden, Jr.

(74) *Attorney, Agent, or Firm* — McKee, Voorhees & Sease, PLC

(57) ABSTRACT

The present invention includes methods and compositions control hard water in an alkaline environment. According to the invention, a unique combination of polymers has been developed which helps to completely control and eliminate hard water. The composition includes a maleic polymer, a hydroxypolycarboxylic acid, and a starch based polymer in a unique synergistic combination that can be used alone, or in combination with standard alkaline detergents in any cleaning regime (laundry, warewash, etc.) where hard water conditions exist.

20 Claims, No Drawings

USE OF A STARCH BASE COPOLYMER IN CONJUNCTION WITH A MALEIC POLYMER AND A HYDROXYPOLYCARBOXYLIC ACID TO CONTROL HARDNESS UNDER ALKALINE CONDITIONS

CROSS REFERENCE TO RELATED APPLICATIONS

This application is a Continuation Application of U.S. Ser. No. 13/662,676 filed Oct. 29, 2012, now U.S. Pat. No. 8,901,057, herein incorporated by reference in its entirety.

FIELD OF THE INVENTION

The present invention is related to a novel polymer combination that can be used in combination with alkaline cleaning compositions or other alkaline cleaning conditions to control water hardness and to prevent hard water scale formation and deposition without the use of phosphorous containing materials.

BACKGROUND OF THE INVENTION

The level of hardness in water can have a deleterious effect in many systems. For example, when hard water alone, or in conjunction with cleaning compositions, contacts a surface, it can cause precipitation of hard water scale on the contacted surface. Scaling is the precipitation of a salt from a solution that is supersaturated with respect to the salt. In general, hard water refers to water having a total level of calcium and magnesium ions in excess of about 100 ppm expressed in units of ppm calcium carbonate. Often, the molar ratio of calcium to magnesium in hard water is about 2:1 or about 3:1. Although most locations have hard water, water hardness tends to vary from one location to another.

Hard water is also known to reduce the efficacy of conventional alkaline detergents used in the vehicle care, warewashing and laundry industries. One method for counteracting this includes adding chelating agents or sequestrants into detersive compositions that are intended to be mixed with hard water in an amount sufficient to handle the hardness. However, in many instances the water hardness exceeds the chelating capacity of the composition. As a result, free calcium ions may be available to cause precipitation, or to attack active components of the composition causing other deleterious effects, such as poor cleaning effectiveness or lime scale build up.

Alkaline detergents, particularly those intended for institutional and commercial use, generally contain phosphates, nitrilotriacetic acid (NTA) or ethylenediaminetetraacetic acid (EDTA) as a sequestering agent to sequester metal ions associated with hard water such as calcium, magnesium and iron and also to remove soils.

In particular, NTA, EDTA or polyphosphates such as sodium tripolyphosphate and their salts are used in detergents because of their ability to solubilize preexisting inorganic salts and/or soils. When calcium, magnesium salts precipitate, the crystals may attach to the surface being cleaned and cause undesirable effects. For example, calcium carbonate precipitation on the surface of ware can negatively impact the aesthetic appearance of the ware, giving an unclean look. The ability of NTA, EDTA and polyphosphates to remove metal ions facilitates the detergency of the solution by preventing hardness precipitation, assisting in soil removal and/or preventing soil redeposition during the wash process.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can reduce the content of phosphorous-containing compounds such as phosphates, phosphonates, phosphites, and acrylic phosphinate polymers, as well as persistent aminocarboxylates such as NTA and EDTA.

Accordingly it is an object herein to provide an improved process for the prevention of scale in alkaline cleaning such as that used in ware washing, hard surface or CIP cleaning, car washing, instrument cleaning, boiler or cooling tower cleaning, laundry cleaning and the like.

It is another object to provide scale control compositions that may be used in conjunction with a cleaning composition for prevention of scale deposits not only on surfaces to be cleaned, but also on the cleaning machine components themselves.

Other objects, aspects and advantages of this invention will be apparent to one skilled in the art in view of the following disclosure, the drawings, and the appended claims.

SUMMARY OF THE INVENTION

The present invention describes methods and compositions using a novel combination of polymers and acids that controls water hardness and can be used in alkaline cleaning conditions. The invention includes a combination of a hydroxypolycarboxylic acid, a maleic polymer and a starch based polymer that provides a phosphorous free composition that provides control of water hardness in alkaline conditions. The invention may be used as a separate composition to use with alkaline cleaners, or may also in some embodiments be combined with a source of alkalinity to make an alkaline cleaner that incorporates the water hardness control composition.

Methods of use of this polymer combination under alkaline conditions relate to prevention of precipitation of calcium and magnesium salts. The methods can be applied in any alkaline environment where it is desirable to prevent the same. For example, the methods can be used in warewashing applications, laundering applications manual pot and pan cleaning, instrument cleaning presoak products and food and beverage applications in consumer, industrial and commercial environments. Additional cleaning applications according to the methods of the invention may include laundry washing and other applications. For example, laundry applications according to the invention may include the use of the compositions with detergents, presoaks, rinse and cleaners, sours, softeners and the like.

In a warewashing embodiment, the invention includes the steps of applying an alkaline cleaning composition to ware, and further applying the polymer composition of the invention which may form a part of the alkaline cleaning composition or which may be added separately, and then rinsing with water.

DETAILED DESCRIPTION OF THIS INVENTION

So that the invention maybe more readily understood, certain terms are first defined.

The term "surfactant" or "surface active agent" refers to an organic chemical that when added to a liquid changes the properties of that liquid at a surface.

"Cleaning" means to perform or aid in soil removal, bleaching, microbial population reduction, rinsing, or combination thereof.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrylonitrile-butadiene-styrene polymers (ABS), and polysulfone polymers (PS). Another exemplary plastic that can be cleaned using the compounds and compositions of the invention include polyethylene terephthalate (PET).

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt.-% and in yet another embodiment, the amount of component is less than 0.01 wt. %.

As used herein, the term "warewashing" refers to washing, cleaning, or rinsing ware.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, "weight percent," "wt. %," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt. %," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g., 1 to 5 includes 1, 1.5, 2, 2.75, 3, 3.80, 4, and 5).

Methods and Compositions of the Invention

The present invention describes methods and compositions using a novel combination of polymers and acids that controls water hardness and can be used in alkaline cleaning conditions. The invention includes a combination of a hydroxypolycarboxylic acid, a maleic polymer and a starch based polymer that provides a phosphorous free composition from biodegradable and bio-based polymers that provides control of water hardness in alkaline conditions. The invention may be used in combination with alkaline cleaners, or may also in some embodiments include a source of alkalinity as well.

The composition comprises at least about 45 ppm of the starch based polymer, at least about 40 ppm of maleic polymer, and greater than 100 ppm active hydroxypolycarboxylic acid. These amounts represent the lowest amount and generally more will give superior hard water removal and treatment. These amounts form the basis of a use composition and may be concentrated as appropriate. The composition can be provided in a concentrate in an amount sufficient to provide a desired level of hard water control when used in the use solution. There should be sufficient amount of hard water control composition to provide the desired hard water inhibiting affect. It is expected that the upper limit on the components will be determined by solubility and critical minimum amounts have been determined. The polymer composition can be provided in the concentrate in an amount of between about 0.005 wt. % and about 41.5 wt. %, and more preferably between about 0.02 wt. % and about 27 wt. % and most preferably between 0.5% and 15% active.

Examples of concentrate on a percent actives basis can include from about 20 wt. % to about 40 wt. % of starch polymer, from about 20 wt. % to about 40 wt. % of maleic polymer and from about 25 wt. % to about 50 wt. % of hydroxypolycarboxylic acid. Preferably, from about 27 wt. % to about 37 wt. % of starch polymer, from about 27 wt. % to about 37 wt. % of maleic polymer and from about 30 wt. % to about 45 wt. % of hydroxypolycarboxylic acid; even more preferably from about 30 wt. % to about 35 wt. % of starch polymer, from about 30 wt. % to about 35 wt. % of maleic polymer and from about 35 wt. % to about 40 wt. % of hydroxypolycarboxylic acid.

Hydroxy Polycarboxylic Acid and Their Metal Salts

The composition of the invention includes a hydroxy polycarboxylic acid preferably forming a metal salt of the hydroxy polycarboxylic acid. A polycarboxylic acid (e.g., a dicarboxylic acid, a tricarboxylic acid, and a tetracarboxylic acid) includes at least one hydroxyl group, and the like. In the hydroxy polycarboxylic acid, the number of hydroxyl groups is not particularly limited to a specific one, and may be, for example, 1 to 4, preferably 1 to 3, and more preferably 1 or 2.

Such a hydroxy polycarboxylic acid may include a hydroxy aliphatic polycarboxylic acid, a hydroxy alicyclic polycarboxylic acid (e.g., a hydroxy $C_{5-8}$ cycloalkane-di- or tricarboxylic acid such as 1,4-dicarboxy-2-hexanol), a hydroxy aromatic polycarboxylic acid (e.g., a hydroxy $C_{6-10}$ arene-di- to tetracarboxylic acid such as hydroxy benzenedicarboxylic acid), and others.

As the hydroxyaliphatic polycarboxylic acid, particularly preferred one includes a hydroxyaliphatic polycarboxylic acid (e.g., a hydroxy$C_{3-22}$ aliphatic di- to tetracarboxylic acid) such as tartronic acid, malic acid, tartaric acid, citric acid, or hydroxyhexadecanedioic acid. Incidentally, a hydroxy polycarboxylic acid having an asymmetric center in a molecule thereof may be in any form of D-, L-, or DL-form, or may be in meso-form.

These hydroxypolycarboxylic acids may form, singly or in combination, a metal salt with a metal. Among these compounds, a mono to dihydroxy$C_{3-10}$ aliphatic di- or tricarboxylic acid (such as D-, L-, DL- or meso formed tartaric acid, D-, L-, or DL-formed malic acid, or citric acid) is particularly preferred.

Metals forming the metal salt may include, for example, an alkali metal (e.g., K, and Na), an alkaline earth metal (e.g., Mg, Ca, and Ba), and metals of Group 3A (e.g., Y), Group 4A (e.g., Ti), Group 5A (e.g., V), Group 6A (e.g., Cr), Group 7A (e.g., Mn), Group 8 (e.g., Fe, Ru, Co, Ni, and Pd), Group 1B (e.g., Cu), Group 2B (e.g., Zn), Group 3B (e.g., Al), and Group 4B (e.g., Sn, and Pb) of Periodic Table of the Elements. The valence of the metal is not particularly limited to a specific one, and may be, for example, 1 to 4 valences, preferably 2 to 4 valences, and more preferably 2 or 3 valences.

Among these metals, it is preferred to use alkali metals, alkaline earth metals, and metals of Group 2B, Group 3B, Group 4B, and Group 8 of Periodic Table of the Elements (particularly alkaline earth metals such as Mg or Ca).

The single metal may form a salt with a hydroxy polycarboxylic acid, or a plurality of the metals in combination may form a double or complexed salt with a hydroxy polycarboxylic acid.

The hydroxy polycarboxylic acid and the metal salt may suitably combine to form the metal salt. Incidentally, the metal salt may be a normal salt, or a hydrogen salt which is a partial metal salt. Moreover, the metal salt may be either a hydrate salt (hydrate salt) or an anhydrous salt. The concrete examples of the metal salt may include, for example, an alkaline earth metal salt of citric acid [e.g., magnesium citrate: $MgH(C_6H_5O_7)_2$, magnesium hydrogen citrate: $MgH(C_6H_5O_7)$, calcium citrate: $Ca_3(C_6H_5O_7)_2$, and calcium hydrogen citrate: $CaH(C_6H_5O_7)$], an alkaline earth metal salt of malic acid [e.g., magnesium malate: $MgC_4H_4O_5$, calcium malate: $CaC_4H_4O_5$, and calcium hydrogen malate: $Ca(HC_4H_4O_5)_2$], an alkaline earth metal salt of tartaric acid [e.g., magnesium tartarate: $MgC_4H_4O_6$, magnesium hydrogen tartarate: $Mg(HC_4H_4O_6)_2$, calcium tartarate: $CaC_4H_4O_6$, and a calcium hydrogen tartarate such as $Ca(HC_4H_4O_6)_2$, $CaH_6(C_4H_4O_6)_4$] and the like.

Among the metal salts, for example, the preferred one includes a salt of an alkaline earth metal (particularly Ca) with a hydroxy$C_{3-6}$ aliphatic di- or tricarboxylic acid (particularly citric acid). Further among these metal salts, calcium citrate (tricalcium citrate), and magnesium citrate are preferred. Moreover, the preferred metal salts also includes a hydrate salt, for example, a hydrate salt of calcium citrate or magnesium citrate (e.g., tricalcium citrate trihydrate, and tricalcium citrate tetrahydrate; magnesium citrate nonahydrate, and magnesium citrate tetradecahydrate), and others.

These metal salts of a hydroxy polycarboxylic acid may be used singly or in combination. In forming a concentrate, the composition of the hydroxypolycarboxlic acid is present in an amount of from about 20 to about 60 percent by weight, about 25 to about 55 percent by weight, and about 30 to about 50 percent by weight. In a use formulation, it must be greater than 100 ppm.

Maleic Polymer Component

The maleic polymer component includes a polycarboxylic acid, preferably polymaleic acid, however other polycarboylic acids such as maleic/acrylic copolymers, maleic terpolymers or mixtures thereof may be used.

Polymaleic acid $(C_4H_2O_3)x$ or hydrolyzed polymaleic anhydride or cis-2-butenedioic acid homopolymer, has the structural formula:

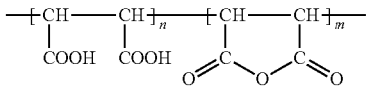

where n and m are any integer.

Examples of polymaleic acid homopolymers (and salts thereof) which may be used for the invention are particularly preferred those with a molecular weight of about 200-2000. Commercially available polymaleic acids include the Belclene 200 series of maleic acid homopolymers from BWA™ Water Additives, 979 Lakeside Parkway, Suite 925 Tucker, Ga. 30084, USA. Particularly preferred is Belclene 200 or Aquatreat AR-801 available from AkzoNobel.

Starch Polymer Component

The starch based polymer composition is a hybrid copolymer of 30-80% starch, 5-60% 2-acrylamido-2-methylpropane sulfonic acid (AMPS), and 0.1 to 5% acrylic acid monomers. More specifically, the polymer is approximately 50% polysaccharide and approximately 50% acrylic and AMPS monomers.

Monomers which make up the composition are preferably acrylic and AMPS, [other examples can include linear, cyclic or branched $C_1$- to $C_{20}$-vinyl esters, ethylene, propylene, vinyl chloride, (meth-)acrylic acid and the linear, cyclic or branched $C_1$- to $C_{20}$-alkyl esters thereof, (meth-)acrylamide and (meth-)acrylamide with N-substituted linear, cyclic or branched $C_1$- to $C_{20}$-alkyl groups, acrylonitrile, styrene, styrene derivatives, such as alpha-methylstyrene ortho-chlorostyrene or vinyl toluene and/or dienes, such as for instance 1,3-butadiene and isoprene. Preferred vinyl esters are linear or branched $C_1$- to $C_{12}$-vinyl esters, such as for instance vinyl acetate, vinyl stearate, vinyl formate, vinyl propionate, vinyl butyrate, vinyl pivalate, vinyl laurate, vinyl-2-ethylhexanoate, 1-methylvinyl acetate and/or $C_9$-, $C_{10}$- and/or $C_{11}$-vinyl versatate, vinyl pyrrolidone, N-vinyl formamide, N-vinyl acetamide, as well as vinyl esters of benzoic acid and p-tert-butylbenzoic acid, with vinyl acetate, vinyl laurate and/or vinyl versatate being preferred in particular. Preferred $C_1$- to $C_{12}$-alkyl groups of (meth-)acrylic acid esters and N-substituted (meth-)acrylamides are methyl, ethyl, propyl, n-butyl, i-butyl, t-butyl, hexyl, cyclohexyl, 2-ethylhexyl, lauryl, stearyl, norbornyl, polyalkylene oxide and/or polyalkylene glycol groups, in particular methyl, butyl, 2-ethylhexyl groups.

Ionic monomers can be used as well, such as the preferred 2-acrylamido-2-methylpropane sulfonic acid (AMPS), as well as styrene sulfonic acid, (meth-)acrylic acid-sulfoalkyl esters, itaconic acid-sulfoalkyl esters, preferably in each case as $C_1$- to $C_6$-alkyl esters, vinyl sulfonic acid and the alkali, alkaline earth and/or ammonium salts thereof. Preferred are monomers containing a (meth)acrylate, a (meth)acrylamide and/or a vinyl group, in particular 2-acrylamido-2-methylpropane sulfonic acid (AMPS), styrene sulfonic acid, acrylic acid-sulfopropyl ester, itaconic acid-sulfopropyl ester, vinyl sulfonic acid, as well as in each case the ammonium, sodium, potassium and/or calcium salts.

In addition, it is also possible to use olefinically unsaturated monomers with cationic functionality. The cationic charge can be prepared either through protonation of amines, in which case it is easily removable in an alkaline medium, or it can for instance be formed through quaternisation of nitrogen atoms. Non-limiting examples of such monomers are amino(meth)acrylates, vinyl pyridines, alkylamino groups-containing vinyl ethers and/or esters, alkylamino groups-containing (meth)acrylates and/or (meth)acrylamides. Preferred cationic monomers are N,N-[(3-chloro-2-hydroxypropyl)-3-dimethylammonium propyl]-(meth)acrylamide chloride, N-[3-dimethylamino)-propyl]-(meth)acrylamide hydrochloride, N-[3-(trimethylammonium)propyl]-(meth-acrylamide chloride, 2-hydroxy-3-(meth)acryloxypropyl-trimethyl ammonium chloride, dimethyldiallyl ammonium chloride, aziridine ethyl(meth)acrylate, morpholinoethyl(meth)acrylate, trimethyl ammoniumethyl(meth)acrylate chloride, dimethylaminopropyl(meth)acrylate, 1,2,2,6,6-pentamethylpiperidinyl(meth)-acrylate, aminopropyl vinyl ether, diethylaminopropyl ether, and t-butylamino-ethyl(meth) acrylate.

As indicated earlier, the monomer component preferably includes approximately 50% of a mixture of acrylic and AMPS monomers with 5-60% 2-acrylamido-2-methylpropane sulfonic acid (AMPS), and 0.1 to 5% acrylic acid monomers.

The polysaccharide component of the starch based polymer composition includes any polysaccharides that are starch derived.

Starch-Based Polysaccharide Component

The starch derived materials comprise a wide variety of starch-based materials including starches derived from cereals, tubers, roots, legumes and fruits, Native starch sources can include corn, pea, potato, banana, barley, wheat, rice, sago, amaranth, tapioca, arrowroot, canna, sorghum, oat, cassava, amioca, and waxy or high amylase varieties thereof.

The starch-based materials can include native starches that are modified using any modification known in the art, including physically modified starches examples of which include sheared starches or thermally-inhibited starches; chemically modified starches including those which have been cross-linked, acetylated, and organically esterified, hydroxyethylated, and hydroxypropylated, phosphorylated, and inorganically esterified, cationic, anionic, nonionic, amphoteric and zwitterionic, and succinate and substituted succinate derivatives thereof; conversion products derived from any of the starches, including fluidity or thin-boiling starches prepared by oxidation, enzyme conversion, acid hydrolysis, heat or acid dextrinization, thermal and or sheared products may also be useful herein; and pregelatinized starches which are known in the art.

Starches that are suitable for use herein include those wherein the starch is gelatinised and the hydrophobic group comprises an alkyl, or an alkenyl group which contains at least five carbon atoms or an aralkyl or aralkenyl group which contains at least six carbon atoms. In one embodiment starches for use in the present invention are starch esters. These will typically have a degree of substitution in the range of from 0.01% to 10%. The hydrocarbon part of the modifying ester should be a C5 to a C16 carbon chain. In one embodiment the ester is octenyl succinate. In another embodiment octenyl succinate (OSAN) substituted waxy corn starches of various types such as 1) waxy starch, acid thinned and OSAN substituted, (2) blend of corn syrup solids: waxy starch, OSAN substituted and dextrinized, 3) waxy starch: OSAN substituted and dextrinised, 4) blend of corn syrup solids or maltodextrins with waxy starch: acid thinned OSAN substituted then cooked and spray dried, 5) waxy starch: acid thinned OSAN substituted then cooked and spray dried; and 6) the high and low viscosities of the above modifications (based on the level of acid treatment) can also be used in the present invention. Mixtures of these, particularly mixtures of the high and low viscosity modified starches are also suitable.

In one embodiment the modified starches comprise a starch derivative containing a hydrophobic group or both a hydrophobic and a hydrophilic group which has been degraded by at least one enzyme capable of cleaving the 1,4 linkages of the starch molecule from the non-reducing ends to produce short chained saccharides to provide high oxidation resistance while maintaining substantially high molecular weight portions of the starch base. Such starches are described in EP-A-922 449.

The polysaccharide may also include a plasticizer for the starch or modified starch. Suitable examples include monosaccharides, disaccharides, and oligosaccharides, such as glucose, sucrose, sorbitol, gum arabic, guar gums and maltodextrin.

Starch-derived materials suitable for use herein include hydrolyzed starches, acid modified starches, enzymatic hydrolyzed starches, octenyl succinic acid anhydride modified starches (OSAN starches), dextrinized OSAN starches, dextrins, maltodextrins, pregelatinized waxy maize starches, and mixtures thereof. Suitable examples of starch-derived materials include, but are not limited to MALTRIN® M100 Maltodextrin, manufactured by Grain Processing Corporation (Muscatine, Iowa); CAPSUL™, CAPSUL TA™, HI-CAP 100™, CAPSUL E™, NARLEX™ (ST and ST2), AND N-LOK, manufactured by Akzo Nobel (Bridgewater, N.J.); the EmCap™ series including 12633, 12634, 12635, 12639, 12635, and 12671, manufactured by Cargill Inc. (Cedar Rapids, Iowa); and STA-DEX® 90 and MIRA-CAP™ Starch, manufactured by Tate & Lyle (Decatur, Ill.). Other examples of modified starches suitable for the present invention are disclosed for example in WO 99/55819, WO 01/40430, EP-A-858828, EP-A-1160311 and U.S. Pat. No. 5,955,419.

Starch based polysaccharides that are preferred include non-amylose starches or those having less than five weight percent amylase and are also known as waxy starches. Examples of these non-amylose starches include but are not limited to waxy tapioca, waxy potato, waxy maize, and dextrins such as pyrodextrins, maltodextrins and beta-limit dextrins. These non-amylose starches may be modified or derivatized, such as by etherification, esterification, acid hydrolysis, dextrinization, oxidation or enzyme treatment (e.g., with .alpha.-amylase, .beta.-amylase, pullulanase, isoamylase, or glucoamylase). Furthermore, non-amylose starches may be derivatized to produce cationic, anionic, amphoteric, or non-ionic materials. Unlike amylose containing starches, non-amylose starches have less of a tendency to retrograde, resulting in better pot life for the binder system. We have found that the combination of non-amylose starches and crosslinkers have pot lives exceeding 24 hours. This means that the viscosity of a 10% binder solution at 25° C. does not increase by more than 500% over a 24-hour period.

The non-amylose starches useful in this invention are water soluble and have a water fluidity of 20 or greater. Water fluidity ("WF"), as used herein, is an empirical test of viscosity measured on a scale of 0-90 wherein fluidity is inversely proportional of viscosity. Water fluidity of starches is typically measured using a Thomas Rotational Shear-type Viscometer (commercially available from Arthur A. Thomas Co., Philadelphia, Pa.), standardized at 30° C. with a standard oil having a viscosity of 24.73 cps. (The oil requires 23.12+-.0.05 sec for 100 revolutions.) Accurate and reproducible measurements of water fluidity are obtained by determining the time which elapses for 100 revolutions at different solids levels depending on the starch's degree of conversion: as conversion increases, the viscosity decreases and the WF values increase. The higher the molecular weight of the starch or the lower the WF value, the better the physical properties such as tensile strength of the binder. However, the higher the molecular weight of the starch or the lower the WF value, the harder it is for the binder to be applied especially in a spray application. Therefore, there is a compromise that needs to be attained between these two opposing factors. In one aspect, the non-amylose starches can have a water fluidity of 40 or greater. In another aspect, the non-amylose starches can have a water fluidity of 60 or greater. In yet another aspect, the non-amylose starches can have a water fluidity of 70 or greater.

Low amylose starches may also be used and are defined as starches having between 5 and 40 weight percent amylose. Typical sources for these low amylose starches are cereals, tubers, roots, legumes and fruits. The native source can be corn, pea, potato, sweet potato, banana, barley, wheat, rice, sago, amaranth, tapioca, arrowroot, canna and sorghum. For purposes of this invention, "stabilized low amylose starches" are defined as low amylose starches whose 10% solutions do not form a gel when stored at 25° C. for at least a 12 hour period after the starch is cooked. Chemically unmodified low amylose starches will retrograde and form a gel or have a significant increase in viscosity when stored as 10% solution at 25° C. in less than 24 hours after the starch is cooked. This gel or viscosity formation makes these starches very difficult to spray and therefore, these starches have not been applied in these applications for binder solution. The stabilized low amylose starches of this invention are chemically or physically modified low amylose starches. The low amylose starches can be chemically modified to produce anionic, nonionic and cationic derivatives. Examples of these stabilized low amylose starches include but are not limited to ether and ester derivatives. The ether derivatives usually resist retrogradation better than ester derivatives, but both types will work. In fact, the "limited" stability associated with esters like starch acetate may be desirable because the starch solutions can be kept stable long enough (for 12 hours or more) to apply to a substrate and then allow some retrogradation which provides useful properties such as water and moisture resistance. Specific examples of the ether derivatives are hydroxyalkylated starches such as hydroxypropylated and hydroxyethylated starches and are preferred. Suitable ester derivatives include the acetate, and half esters, such as the succinate and alkenyl succinate, prepared by reaction with acetic anhydride, succinic anhydride, and alkenyl succinic anhydride, respectively; phosphate derivatives prepared by reaction with sodium or potassium orthophosphate or sodium or potassium tripolyphosphate; Starch esters and half-esters, particularly starch alkenyl (for example: octenyl and dodecyl) succinate derivatives substituted by alkenyl succinic anhydride are especially useful in the present invention. The preferred degrees of substitutions (DS's) are in the range 0.001 to 1.0 preferably in the range 0.005 to 0.5 and most preferably in the range 0.01 to 0.1.

The stabilized low amylose starches useful in this invention are water soluble and have a water fluidity of 20 or greater. In one aspect, the stabilized low amylose starches can have a water fluidity of 40 or greater. In another aspect, the stabilized low amylose starches can have a water fluidity of 60 or greater. In yet another aspect, the stabilized low amylose starches can have a water fluidity of 70 or greater.]

As indicated earlier, the monomer component preferably includes approximately 50% of a mixture of acrylic and AMPS monomers with 5-60% 2-acrylamido-2-methylpropane sulfonic acid (AMPS), and 0.1 to 5% acrylic acid monomers.

Cleaning/Detergent Compositions Employing the Polymer Compositions of the Invention The hard water control polymer composition of the invention may be included as a component of a detergent/cleaning composition, which would include other components such as a source of alkalinity. Sources of alkalinity can comprise alkali silicate, carbonate, hydroxide and mixtures and combinations thereof.

The cleaning composition may also include one or more agents selected from builders (i.e. detergency builders including the class of chelating agents/sequestering agents), bleaches, enzymes and surfactants. The source of alkalinity can comprise from about 45-98 wt. % a second range of 55-95 wt. % and a third range of 65-90% of the detergent composition.

Source of Alkalinity

The source of alkalinity can be any source of alkalinity that is compatible with the other components of the detergent composition and that will provide a use solution with the desired pH. Exemplary sources of alkalinity include alkali metal hydroxides, alkali metal salts, silicates, amines, and mixtures thereof. Exemplary alkali metal hydroxides include sodium hydroxide, potassium hydroxide, and lithium hydroxide. The alkali metal hydroxide may be added to the composition in a variety of forms, including for example in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45 wt. %, 50 wt. % and a 73 wt. % solution.

Exemplary alkali metal salts include sodium carbonate, trisodium phosphate?, potassium carbonate, and mixtures thereof. Exemplary silicates include sodium metasilicates, sesquisilicates, orthosilicates, potassium silicates, and mixtures thereof. Exemplary phosphates include sodium pyrophosphate, potassium pyrophosphate, and mixtures thereof. Exemplary amines include alkanolamine. Exemplary alkanolamines include triethanolamine, monoethanolamine, diethanolamine, and mixtures thereof.

The source of alkalinity is provided in an amount sufficient to provide the use solution with a pH of at least 8.0. The use solution pH range is preferably between about 8.0 and about 13.0, and more preferably between 10.0 to 12.5. In general, the amount of alkalinity provided in the concentrate can be in an amount of at least about 0.05 wt. % based on the weight of the alkaline concentrate. The source of alkalinity in the concentrate is preferably between about 0.05 wt. % and about 99 wt. %, more preferably is between about 0.1 wt. % and about 95 wt. %, and most preferably is between 0.5 wt % and 90 wt %.

Surfactants

In some embodiments, the compositions of the present invention include a surfactant. Surfactants suitable for use with the compositions of the present invention include, but are not limited to, nonionic surfactants, anionic surfactants, and zwitterionic surfactants. In some embodiments, the compositions of the present invention include about 10 wt % to about 50 wt % of a surfactant. In other embodiments the compositions of the present invention include about 15 wt % to about 30% of a surfactant. In still yet other embodiments, the compositions of the present invention include about 25 wt % of a surfactant.

Nonionic Surfactants

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Semi-Polar Nonionic Surfactants

The semi-polar type of nonionic surface active agents are another class of nonionic surfactant useful in compositions of the present invention. Semi-polar nonionic surfactants include the amine oxides, phosphine oxides, sulfoxides and their alkoxylated derivatives.

Amine oxides are tertiary amine oxides corresponding to the general formula:

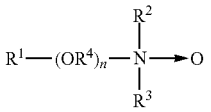

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Anionic Surfactants

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

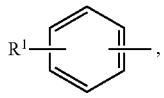

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

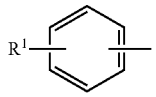

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

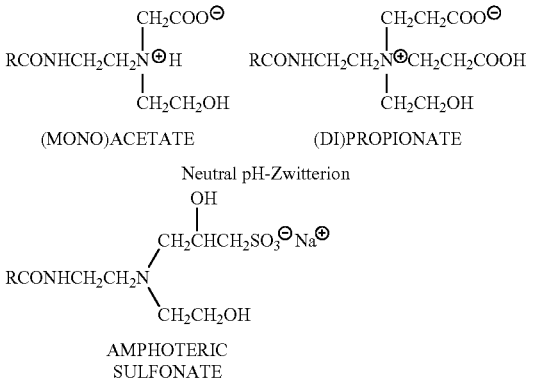

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R=C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

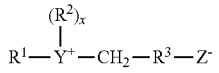

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

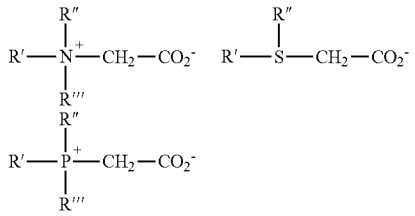

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g., methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Additional Functional Ingredients

The compositions may also include additional materials, such as additional functional materials, for example, an additional source of alkalinity, an additional surfactant, an additional chelating agent, anticorrosion agents, a sequestering agent, a bleaching agent, a thickening agent, a solubility modifier, a detergent filler, wetting agents, enzymes, foam inhibitors, antiredeposition agents, anti-etch agents, antimicrobial agents a threshold agent or system, an aesthetic enhancing agent (i.e. dye, perfume, etc.) and the like, or combinations or mixtures thereof including other ingredients useful in imparting a desired characteristic or functionality in the detergent composition.

Adjuvants and other additive ingredients will vary according to the type of composition being manufactured and can be included in the compositions in any amount. In at least some embodiments, any additional functional materials that are added to the composition are compatible with the other components within the composition. Other active ingredients may optionally be used to improve the effectiveness of the hard water control composition or cleaning/detergent composition. These components may be present in either the cleaning composition which employs the polymer hard water control component of the invention, or may be present in polymer hard water control formulations themselves. The following describes some examples of such ingredients.

Dye or Odorant

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as ClS-jasmine orjasmal, vanillin, and the like.

Anticorrosion Agents

The composition may optionally include anticorrosion agents. Anticorrosion agents provide compositions that generate surfaces that are shiner and less prone to biofilm buildup than surfaces that are not treated with compositions having anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, molybdate containing components, and borate containing components. Exemplary phosphates or phosphonic acids are available under the name Bayhibit (2-phosphonobutane 1,2,4 tricarboxylic acid) available from LANXESS AG 51369 Leverkusen Germany, DE; and Dequest (i.e., Dequest 7000) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine. When an anticorrosion agent is incorporated into the composition, it is preferably included in an amount of between about 0.05 wt. % and about 5 wt. %, between about 0.5 wt. % and about 4 wt. % and between about 1 wt. % and about 3 wt. %.

Chelant

The hard water control compositions, or detergent composition incorporating the same can also include a chelant at a level of from 0 wt. % to 50 wt. %, preferably from 0 wt. % to 30 wt. %, more preferably from 0 wt. % to 10 wt % by weight of total scale inhibiting composition. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinse away and do not form a deposit.

Suitable chelating agents can be selected from the group consisting of amino carboxylates, amino phosphonates, polyfunctionally-substituted aromatic chelating agents and mixtures thereof. Preferred chelants for use herein are weak chelants such as the amino acids based chelants and preferably citrate, citrate, tararate, and glutamic-N,N-diacetic acid and derivatives and/or Phosphonate based chelants and preferably Diethylenetriamine penta methylphosphonic acid.

Amino carboxylates include ethylenediaminetetra-acetates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), .quadrature.-alanine-N,N-diacetic acid (.quadrature.-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid is also suitable.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis(methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants for use herein include citric acid, lactic acid, acetic acid, succinic acid, formic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Bleaching Agent

Suitable bleaches for use in the alkaline cleaning compositions or scale control compositions of the invention may generally be halogen-based bleaches or oxygen-based bleaches. However, oxygen-based bleaches are preferred.

If no enzyme material is present in the system of the invention, a halogen-based bleach may be effectively used as ingredient of the first component. In that case, said bleach is desirably present at a concentration (as active halogen) in the range of from 0.1 to 10%, preferably from 0.5 to 8%, more preferably from 1 to 6%, by weight. As halogen bleach, alkali metal hypochlorite may be used. Other suitable halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium percarbonate or hydrogen peroxide. These are preferably used in conjunction with a bleach activator which allows the liberation of active oxygen species at a lower temperature. Numerous examples of activators of this type, often also referred to as bleach precursors, are known in the art and amply described in the literature such as U.S. Pat. No. 3,332,882 and U.S. Pat. No. 4,128,494 herein incorporated by reference. Preferred bleach activators are tetraacetyl ethylene diamine (TAED), sodium nonanoyloxybenzene sulphonate (SNOBS), glucose pentaacetate (GPA), tetraacetylmethylene diamine (TAMD), triacetyl cyanurate, sodium sulphonyl ethyl carbonic acid ester, sodium acetyloxybenzene and the mono long-chain acyl tetraacetyl glucoses as disclosed in WO-91/10719, but other activators, such as choline sulphophenyl carbonate (CSPC), as disclosed in U.S. Pat. No. 4,751,015 and U.S. Pat. No. 4,818,426 can also be used.

Peroxybenzoic acid precursors are known in the art as described in GB-A-836,988, herein incorporated by reference. Examples of suitable precursors are phenylbenzoate, phenyl p-nitrobenzoate, o-nitrophenyl benzoate, o-carboxyphenyl benzoate, p-bromophenyl benzoate, sodium or potassium benzoyloxy benzene sulfonate and benzoic anhydride.

Preferred peroxygen bleach precursors are sodium p-benzoyloxy-benzene sulfonate, N,N,N,N-tetraacetyl ethylene diamine (TEAD), sodium nonanoyloxybenzene sulfonate (SNOBS) and choline sulfophenyl carbonate (CSPC).

The amounts of sodium perborate or percarbonate and bleach activator in the first component preferably do not exceed 30% respectively 10% by weight, e.g. are in the range of from 4-30% and from 2-10% by weight, respectively.

Wetting Agents

The cleaning compositions may include a wetting agent which can raise the surface activity of the composition of the invention. The wetting agent may be selected from the list of surfactants previously described. Preferred wetting agents include Triton CF 100 available from Dow Chemical, Abil 8852 available from Goldschmidt, and SLF-18-45 available from BASF. The wetting agent is preferably present from about 0.1 wt. % to about 10 wt. %, more preferably from about 0.5 wt. % to 5 wt. %, and most preferably from about 1 wt. % to about 2 wt. %.

Enzymes

The composition of the invention may include one or more enzymes, which can provide desirable activity for removal of protein-based, carbohydrate-based, or triglyceride-based soils from substrates such as flatware, cups and bowls, and pots and pans. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. A valuable reference on enzymes is "Industrial Enzymes," Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980. The concentrate need not include an enzyme. When the concentrate includes an enzyme, it can be included in an amount that provides the desired enzymatic activity when the warewashing composition is provided as a use composition. Exemplary ranges of the enzyme in the concentrate include between about 0 and about 15 wt. %, between about 0.5 wt. % and about 10 wt. %, and between about 1 wt. % and about 5 wt. %.

Foam Inhibitors

A foam inhibitor may be included for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein. The composition preferably includes from about 0.0001 wt. % to about 5 wt. % and more preferably from about 0.01 wt. % to about 3 wt. % of the foam inhibitor.

Additional Threshold Inhibitor/Crystal Modifier/Dispersant Component

The detergent composition may also include a threshold agent of crystal modifier for reducing precipitation of calcium carbonate in the use solution. In general, it is expected that the threshold inhibitor/crystal modifier component will loosely hold calcium to reduce precipitation of calcium carbonate once it is subjected to a pH of at least 8.0.

Exemplary threshold inhibitor/crystal modifier components include phosphonocarboxylic acids, phosphonates, polymers, and mixtures thereof. Exemplary phosphonocarboxylic acids include those available under the name Bayhibit™ AM from Bayer, and include 2-phosphonobutane-1, 2,4, tricarboxylic acid (PBTC). Exemplary phosphonates include amino tri(methylene phosphonic acid), 1-hydroxy ethylidene 1-1-diphosphonic acid, ethylene diamine tetra(methylene phosphonic acid), hexamethylene diamine tetra(methylene phosphonic acid), diethylene triamine penta(methylene phosphonic acid), and mixtures thereof. Exemplary phosphonates are available under the name Dequest™ from Monsanto. Exemplary polymers include polyacrylates, polymethacrylates, polyacrylic acid, polyitaconic acid, polymaleic acid, sulfonated polymers, copolymers and mixtures thereof. It should be understood that the mixtures can include mixtures of different acid substituted polymers within the same general class. In addition, it should be understood that salts of acid substituted polymers can be used. The useful carboxylated polymers may be generically categorized as water-soluble carboxylic acid polymers such as polyacrylic and polymethacrylic acids or vinyl addition polymers, in addition to the acid-substituted polymers used in the present invention. Of the vinyl addition polymers contemplated, maleic anhydride copolymers as with vinyl acetate, styrene, ethylene, isobutylene, acrylic acid and vinyl ethers are examples. The polymers tend to be water-soluble or at least colloidally dispersible in water. The molecular weight of these polymers may vary over a broad range although it is preferred to use polymers having average molecular weights ranging between 1,000 up to 1,000,000. These polymers have a molecular weight of 100,000 or less and between 1,000 and 10,000.

The polymers or copolymers (either the acid-substituted polymers or other added polymers) may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

The threshold inhibitor/crystal modifier component should be provided in an amount sufficient so that when it is in the use solution, it sufficiently prevents the precipitation of calcium carbonate, and other insoluble salts such as magnesium silicate, magnesium hydroxide and the like or disrupts crystal growth. The threshold inhibitor/crystal modifier component can be provided in an amount of at least about 0.0001 wt. %, and can be provided in a range of between about 0.0001 wt. % and about 25 wt. % based on the weight of the concentrate, and more preferably can be provided in a range of between about 0.001 wt. % and about 10 wt. % based on the weight of the concentrate and most preferably between about 0.01 and 8% based on the weight of the concentrate. It should be understood that the polymers and the phosphonocarboxylates and phosphanates can be used alone or in combination.

Hydrotrope Component

A hydrotrope component can be used to help stabilize the surfactant component. It should be understood that the hydrotrope component is optional and can be omitted if it is not needed for stabilizing the surfactant component. In many cases, it is expected that the hydrotrope component will be present to help stabilize the surfactant component. Examples of the hydrotropes include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols, short chain ($C_8$ or less) alkyl polyglycoside, sodium, potassium and ammonium salts of the alkyl sarcosinates, salts of cumene sulfonates, amino propionates, diphenyl oxides, and disulfonates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of detergent composition.

Antiredeposition Agents

The composition may also include an antiredeposition agent capable of facilitating sustained suspension of soils in a cleaning solution and preventing the removed soils from being redeposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like. The composition preferably includes from about 0.5 wt. % to about 10 wt. % and more preferably from about 1 wt. % to about 5 wt. % of an antiredeposition agent.

Anti-Etch Agents

The composition may also include an anti-etch agent capable of preventing etching in glass. Examples of suitable anti-etch agents include adding metal ions to the composition such as zinc, zinc chloride, zinc gluconate, aluminum, and beryllium. The composition preferably includes from about 0.1 wt. % to about 10 wt. %, more preferably from about 0.5 wt. % to about 7 wt. %, and most preferably from about 1 wt. % to about 5 wt. % of an anti-etch agent.

Use Compositions

The compositions of the present invention include concentrate compositions and use compositions. For example, a concentrate composition can be diluted, for example with water, to form a use composition. In an embodiment, a concentrate composition can be diluted to a use solution before to application to an object. For reasons of economics, the concentrate can be marketed and an end user can dilute the concentrate with water or an aqueous diluent to a use solution.

The level of active components in the concentrate composition is dependent on the intended dilution factor and the desired activity of the hardness control composition. Generally, a dilution of about 1 fluid ounce to about 10 gallons of water to about 10 fluid ounces to about 1 gallon of water is used for aqueous compositions of the present invention. In some embodiments, higher use dilutions can be employed if elevated use temperature (greater than 25° C.) or extended exposure time (greater than 30 seconds) can be employed. In the typical use locus, the concentrate is diluted with a major proportion of water using commonly available tap or service water mixing the materials at a dilution ratio of about 3 to about 40 ounces of concentrate per 100 gallons of water.

In some embodiments, when used in a laundry application, the concentrated compositions can be diluted at a dilution ratio of about 0.1 g/L to about 100 g/L concentrate to diluent, about 0.5 g/L to about 10.0 g/L concentrate to diluent, about 1.0 g/L to about 4.0 g/L concentrate to diluent, or about 1.0 g/L to about 2.0 g/L concentrate to diluent.

In other embodiments, a use composition can include about 0.01 to about 10 wt-% of a concentrate composition and about 90 to about 99.99 wt-% diluent; or about 0.1 to about 1 wt-% of a concentrate composition and about 99 to about 99.9 wt-% diluent.

Amounts of an ingredient in a use composition can be calculated from the amounts listed above for concentrate compositions and these dilution factors. In some embodiments, for example when used in a laundry application, the concentrated compositions of the present invention are diluted such that the starch based polymer, maleic polymer and hydroxypolycarboxylic acid are present in the ppm amounts indicated earlier, at least about 45 ppm of the starch based polymer, at least about 40 ppm of maleic polymer, and greater than 100 ppm active hydroxypolycarboxylic acid. It is to be understood that all values and ranges between these values and ranges are encompassed by the present invention.

Laundry Applications

In some aspects, the compounds and compositions can also be employed in laundry applications where hard water is involved. The articles are contacted with the compositions of the invention at use temperatures in the range of about 4° C. to 80° C., for a period of time effective to clean the articles. For example, in some embodiments, the compositions of the present invention can be injected into the wash or rinse water of a laundry machine. In some embodiments, the soiled fabric is contacted with the compositions of the present invention for about 5 to about 30 minutes. Excess solution can then be removed by rinsing or centrifuging the fabric.

The compositions of the present invention can be used to launder any conventional textile, including but not limited to, cotton, poly-cotton blends, wool, and polyesters.

The compositions of the present invention can be used alone to treat the articles, e.g., textiles, or can be used in conjunction with conventional detergents suitable for the articles to be treated. The compositions of the invention can be used with conventional detergents in a variety of ways, for example, the compositions of the invention can be formulated with a conventional detergent. In other embodiments, the compositions of the invention can be used to treat the article as a separate additive from a conventional detergent. When used as a separate additive, the compositions of the present invention can contact the article to be treated either before of simultaneous with the detergent.

Clean in Place

Other cleaning applications for the compositions of the present invention include any process where hard water may be involved such as clean-in-place systems (CIP), clean-out-of-place systems (COP), textile laundry machines, ultra and nano-filtration systems and indoor air filters. COP systems can include readily accessible systems including wash tanks, soaking vessels, mop buckets, holding tanks, scrub sinks, vehicle parts washers, non-continuous batch washers and systems, and the like. CIP systems include the internal components of tanks, lines, pumps and other process equipment used for processing typically liquid product streams such as beverages, milk, and juices.

Generally, the cleaning of the in-place system or other surface (i.e., removal of unwanted offal therein) is accomplished with a different material such as a formulated alkaline detergent which is introduced with heated water. The compositions of the invention may be introduced during, prior to the cleaning step and are applied or introduced into the system at a use solution concentration in unheated, ambient temperature water. CIP typically employ flow rates on the order of about 40 to about 600 liters per minute, temperatures from ambient up to about 70° C., and contact times of at least about 10 seconds, for example, about 30 to about 120 seconds. The present composition can remain in solution in cold (e.g., 40° F./4° C.) water and heated (e.g., 140° F./60° C.) water. Although it is not normally necessary to heat the aqueous use solution of the present composition, under some circumstances heating may be desirable to further enhance its activity. These materials are useful at any conceivable temperatures.

The Warewashing Process

The inventive hard water control compositions of the invention may be generally utilized in any of the conventional, domestic and institutional, warewashing machines.

Typical institutional warewashing processes are either continuous or non-continuous and are conducted in either a single-tank or a multi-tank/conveyor-type machine.

In the conveyor-type system prewash, wash, post-wash rinse and drying zones are generally established using partitions. Wash water is introduced into the post-wash rinsing zone and is passed cascade-fashion back toward the prewash zone while the dirty dishware is transported in a counter-current direction. In an alternative (so called "by-pass") process, this rinse-water is introduced into the pre-wash zone. It may be attractive to combine this "by-pass" process with the method of the present invention, because in this way a pH-gradient is created over the wash tanks, which is likely to lead to more optimal conditions for soil removal. For instance, enzymes—when present in the first component—can become more active at the more neutral pH-conditions resulting from the introduction of acid post-wash rinse composition into the prewash zone. Various multi-tank warewashing machines have the option to rinse only when dishes are passed through the post-wash rinsing section. It can be attractive to combine this option with the method of the present invention, because in that way the volume of the acid rinse solution is limited. Such limited acid rinse volume will only have a limited effect as to its ability to reduce the alkalinity of the main wash solution.

Furthermore, each component of the cleaning system of the invention is applied in the warewashing machine using conventional means such as suitable spray nozzles or jets directed upwards and/or downwards toward the dishware.

The compositions of the invention may be added as a component of the alkaline detergent, or as a pre-wash or even post-wash treatment.

Formulating the Hard Water Control Composition

The hard water control_ composition can be formulated to handle the expected hard water level in a given environment. That is, the concentration of the composition in a cleaning composition or used alone can be adjusted depending upon several factors at the situs of use including, for example, water hardness level, food soil concentration, alkalinity and the like. In machine warewashing applications, a food soil concentration of about 25 grams per gallon or more is considered high, a concentration of about 15 to about 24 grams per gallon is considered medium, and a concentration of about 14 grams per gallon or less is considered low. Water hardness exhibiting 15 grains per gallon or more is considered high, about 6 to about 14 grains per gallon is considered medium, and about 5 grains per gallon or less is considered low. In a use composition, an alkalinity of about more than 450 ppm or higher is considered high, an alkalinity of about 300 ppm to about 450 ppm is considered medium, and an alkalinity of about 300 ppm or less is considered low.

Forming a Concentrate

The components can be mixed and extruded or cast to form a solid such as pellets, powders or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the scale control component may be separate from the remainder of the warewash detergent. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The solidification process may last from a few minutes to about six hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 1 minute to about 2 hours, most preferably about 1 minute to about 1.0 hours minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. The composition is processed at around 150-170° F. and are generally cooled to 100-150° before packaging, so that processed mixture may be cast or extruded directly into the container or other packaging system without structurally damaging the material. As a result, a wider variety of materials may be used to manufacture the container than those used for compositions that processed and dispensed under molten conditions.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will erode a surface of the concentrate to provide a liquid concentrate that will be introduced into the dishwashing machine.

The present hard water control composition can be provided in any of a variety of embodiments of detergent or treatment compositions. In an embodiment, the composition is substantially free of phosphorous-containing compounds, nitrilotriacetic acid (NTA) and ethylenediaminetetraacetic acid (EDTA). Substantially phosphorous-free refers to a composition to which phosphorous-containing compounds are not added. Should phosphorus-containing compounds be present through contamination, the level of phosphorus-containing compounds in the resulting composition is less than approximately 10 wt %, less than approximately 5 wt %, less than approximately 1 wt %, less than approximately 0.5 wt %, less than approximately 0.1 wt %, and often less than approximately 0.01 wt %. Substantially NTA or EDTA-free refers to a composition to which NTA or EDTA are not added. Should NTA or EDTA be present through contamination, the level of NTA or EDTA in the resulting composition is less than approximately 10 wt %, less than approximately 5 wt %, less than approximately 1 wt %, less than approximately 0.5 wt %, less than approximately 0.1 wt %, and often less than approximately 0.01 wt %. When the cleaning composition is NTA-free, the cleaning composition is also compatible with chlorine, which functions as an anti-redeposition and stain-removal agent.

The hard water control composition may be made using a mixing process. The polymers including the starch polymer, the maleic polymer and the hydroxypolycarboxylic acid and optional detergent components such as an alkalinity source, surfactant or surfactant system and other functional ingredients are mixed for an amount of time sufficient to form a final, homogeneous composition. In an exemplary embodiment, the components of the cleaning composition are mixed for approximately 10 minutes.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the cleaning composition under the expected conditions of storage and use of the solid cleaning composition. In general, it is expected that the cleaning composition will remain a solid when provided at a temperature of up to about 100° F. or lower than about 120° F.

In certain embodiments, the solid cleaning composition is provided in the form of a unit dose. A unit dose refers to a solid cleaning composition unit sized so that the entire unit is used during a single cycle, for example, a single washing cycle of a warewash machine. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a solid having a mass of about 5 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to about 500 g.

While the invention is described in the context of a warewashing composition for washing articles in an automatic dishwashing machine, it should be understood that the detergent compositions employing the scale control composition can be used for washing non-ware items. That is, the warewashing composition can be referred to as a cleaning composition and can be used to clean various items. It should be understood that certain components that may be included in a warewashing composition because it is intended to be used in an automatic dishwashing machine can be excluded from a cleaning composition that is not intended to be used in an automatic dishwashing machine, and vice versa. For example, surfactants that have a tendency to create quite a bit of foaming may be used in a cleaning composition that is not intended to be used in an automatic dishwashing machine.

Exemplary ranges of warewashing compositions which employ the hard water control polymer composition include a source of alkalinity, and a surfactant or surfactant system. The source of alkalinity typically comprises between a first range of 45-60 wt. % a second range of 55-95 wt. % and a third range of 65-90%. The hard water control component would be the remainder.

TABLE 1

Representation warewash block detergent compositions with the polymer hard water control component of the invention (percent by weight):

| | First range | second range | third range |
|---|---|---|---|
| Polymer composition | 30-50 | 20-60 | 10-70 |
| Surfactant | 0-10 | 0-15 | 0-20 |
| Caustic | 45-60 | 40-65 | 35-70 |

The present invention will now be further illustrated by way of the following non-limiting examples, in which parts and percentages are by weight unless otherwise indicated.

The invention will now be illustrated by the following non-limiting examples.

EXAMPLES

New regulations restricting the use of phosphorus containing materials created the need to search for alternatives. The alternatives depend on the ability of combination of polymers and carboxylate containing molecules to prevent the precipitation of calcium carbonate and magnesium hydroxide. However, the polymers used are made from synthetic materials and most of the time are not biodegradable. On our search for more environmentally friendly materials we directed our research toward more green products and proceeded to test a product synthesized by ALCO and identified as EXP 5025 (starch/AMPS copolymer) which is at least 60% biodegradable, in combination with a low molecular weight polymaleic acid polymer which is also biodegradable. The combination of the two polymers together with the use of trisodium citrate was able to totally control water hardness and prevent precipitation of calcium and magnesium on both the glasses and the surface of the washing machines.

Formulations

Pluronic N3 is a polyoxypropylene-polyoxyethylene block copolymer nonionic surfactant available from BASF Corporation, Florham Park, N.J.

AQUATREAT® AR 801 is a low molecular weight partially neutralized maleic homopolymer available from Akzo Nobel, Chicago, Ill.;

EXP 5025 is a hybrid copolymer of starch/AMPS (2-acrylamido-2-methyl propane sulfonic acid) synthesized by ALM Chemical Inc., Chattanooga, Tenn.

Food and Beverage Test Method

Apparatus:

4 place stirrer/hot plate with temperature control 1000 ml or 1500 ml beakers

Graduated 10 ml pipettes

Reagent Preparation:

Hardness Solution:

Dissolve 33.45 g of $CaCl_2$ $2H_2O$+23.24 g $MgCl_2$ $6H_2O$ in a 1 liter volumetric flask and dilute to volume with DI water.

Sodium Bicarbonate Solution:

Dissolve 56.25 g $NaHCO_3.2H_2O$ in a 1 liter volumetric flask and dilute to volume with DI water.

Procedure:

1. Use four 1000 or 1500 ml beakers.
2. Add 1000 ml of DI water and 1½" stir bar to each.
3. Place on a 4 place stirrer and begin to heat.
4. Add 5.00 mls of sodium bicarbonate solution to each.
5. When water temperature reaches 85° F., add hardness solution to each, 1 ml=2 grains, run in increments of 2 grains unless otherwise specified.
6. Add 4.00 mls of sample to each unless otherwise specified in request or attached product list. This will be equal to 0.40% or 1 ounce/2 gallons. If sample is thick or does not flow well, add sample based on the weight of 4.00 mls (4×specific gravity=x.xx grams).
7. After sample is completely mixed, turn off stirrer.
8. When temperature reaches 85° F., take initial reading (0 minutes).
9. Take readings of the transmittance at 560 nm, at 85° F., 140° F., and 160° F.

Several different formulations were tested with differing amounts of the components.

The best results are observed when at least about 45 ppm of the starch based polymer, at least about 40 ppm of maleic polymer, and greater than 100 ppm active hydroxypolycarboxylic acid are present.

100 Cycle Test

Two different concentrations of sodium citrate were tested according to the invention: one at 115 g and one at 172.5 g with the remainder of the components as specified herein.

100 cycle warewash testing was performed using six 10 oz. Libbey glasses on a Hobart AM-14 or AM-15 warewash machine and 17 grain hardness water (1 grain=17.11854 ppm). The specifications of the Hobart MA-15 and AM-14 are:

| | Hobart AM-14 | Hobart AM-15 |
|---|---|---|
| Wash Tank Volume | 60.00 lit/15.85 gal | 53 lit/14 Gal |
| Rinse Volume/Rack | 4.50 lit/1.19 gal. | 2.8 lit/0.74 gal. |
| Wash Time | 50 sec. | 50 sec. |
| Rinse Time | 9 sec | 10 sec. |

100 Cycle Test Procedure

100 Cycle Warewash Test Procedure:

One Hundred-Cycle Film Evaluation for Institutional Warewash Detergents

Purpose:

To provide a generic method for evaluating glass and plastic film accumulation in an institutional warewash machine. This procedure is used to evaluate test formulations, Ecolab products, and competitive products.

Principle:

Test glasses are washed in an institutional warewash machine with a predetermined concentration of detergent. All of the glasses are left untreated and examined for film accumulation.

Apparatus and Materials:

1. Institutional machine hooked up to the appropriate water supply
2. Raburn glass rack
3. Libbey heat resistant glass tumblers, 10 oz.
4. Cambro Newport plastic tumblers
5. Sufficient detergent to complete the test
6. Titrator and reagents to titrate alkalinity
7. Water hardness test kit Preparation:

1. Clean 6 glasses or obtain new glasses.
2. Fill the dishmachine with the appropriate water. Test the water for hardness. Record the value. Turn on tank heaters.
3. Turn on the dishmachine and run wash/rinse cycles through the machine until a wash temperature of 150-160° F. and rinse temperature of 175-190° F. is reached.
4. Set controller to dispense appropriate amount of detergent into the wash tank. Titrate to verify detergent concentration.
5. Place 6 clean glasses diagonally and four plastic tumblers off-diagonally in the Raburn rack (see figure below for arrangement) and place the rack inside the dishmachine. G-glass tumblers, P=plastic tumbler and place the rack inside the dishmachine.

| | | | | | |
|---|---|---|---|---|---|
| | | | | | G |
| | | | | G | |
| | | | G | | |
| | | G | | | |
| | G | | | P | |
| G | | | | | |

6. Begin 100 cycle test
7. At the beginning of each wash cycle, the appropriate amount of detergent is automatically dispensed into the warewash machine to maintain the initial detergent concentration. Detergent concentration is controlled by conductivity.

Procedure:

1. Begin 100 cycle test
2. After the completion of each cycle, the machine is appropriately dosed (automatically) to maintain the initial concentration.
3. Let the glasses and tumblers dry overnight. Grade all glasses for film accumulation using Image Analysis. (a number around 15000 indicates a perfectly clean glass. Any number lower than 40000 is visually acceptable for scale control performance.)

Light Box Evaluation of 100 Cycle Glasses:

The light box test standardizes the evaluation of the glasses run in the 100 cycle test using an analytical method. The light box test is based on the use of an optical system using including a photographic camera, a light box, a light source, and a light meter. The system is controlled by a computer program (Spot Advance and Image Pro Plus).

To evaluate the glasses, each glass is placed on the light box resting on its side and the intensity of the light source, is adjusted to a predetermined value using a light meter.

The conditions of the 100 cycle test are entered into the computer. A picture of the glass is taken with the camera and saved on the computer for analysis by the program. The picture was analyzed using the upper half of the glass in order to avoid the gradient of darkness on the film from the top of the glass to the bottom of the glass, based on the shape of the glass.

Generally, a lower light box rating indicates that more light is able to pass through the glass. Thus, the lower the glass rating, the more effective the composition is at preventing scale on the surface on the glass, Light box evaluation of a clean, unused glass has a light box score of approximately 12,000 which corresponds to a score of 72,000 for the sum of the six glasses.

Light box evaluation of a clean, unused plastic tumbler has a light box of approximately 25,000.

The minimum the obtainable score for 6 glasses and one plastic tumbler is approximately 97,000.

What is claimed is:

1. A hardness control composition for use in alkaline cleaning conditions comprising:

a starch based hybrid polymer, a maleic polymer and a hydroxycarboxylic acid salt; wherein said starch based hybrid polymer comprises 30 wt. % to 80 wt. % of a hybrid copolymer of starch, 5 wt. % to 60 wt. % of AMPS, and 0.1 wt. % to about 5 wt. % of an acrylic acid monomer.

2. The hardness control composition of claim 1 wherein said starch based polymer is present in an amount of 0.005 wt. % to about 41.5 wt, % of the composition.

3. The hardness control composition of claim 1 wherein said maleic polymer is present in an amount of from about 20 wt. % to about 40 wt.

4. The hardness control composition of claim 1 wherein said hydroxylcarboxylic acid salt is present in an amount of from about 25 wt. % to about 50 wt. %.

5. The scale control composition of claim 1 wherein said hybrid copolymer of starch comprises approximately 50% of the starch based hybrid polymer.

6. The scale control composition of claim 1 wherein the hydroxycarboxylic acid salt is sodium citrate.

7. The hardness control composition of claim 1 wherein said starch based polymer is present in an amount of about 45 ppm, with at least about 40 ppm maleic polymer and greater than 100 ppm active hydroxylcarboxylic acid.

8. The hardness control composition of claim 1 further comprising a chelant.

9. The hardness control composition of claim 1 comprising:

a starch based polymer is present in an amount of 0.005 wt. % to about 41.5 wt. %, wherein said starch based hybrid polymer comprises 30 wt. % to 80 wt. % of a hybrid copolymer of starch, 5 wt. % to 60 wt. % of AMPS, and 0.1 wt. % to about 5 wt. % of an acrylic acid monomer;

a maleic polymer is present in an amount of from about 20 wt. % to about 40 wt. %; and a hydroxylcarboxylic acid salt is present in an amount of from about 25 wt. % to about 50 wt. %.

10. The hardness control composition of claim 9 wherein said starch based polymer is present in an amount of 27.5 wt. %;

a maleic polymer is present in an amount of from about 31.5 wt. %; and a hydroxylcarboxylic acid salt is present in an amount of from about 36 wt. %.

11. A warewash detergent comprising an effective amount of the hardness control composition of claim 1.

12. The warewash detergent of claim 11 wherein said hard water control composition is present in an amount of from about 0.005 wt. % to about 41.5 wt. %.

13. The ware wash detergent of claim 12 wherein said hard water control composition is present in an amount of from about 0.02 wt. % to about 27 wt. %.

14. The ware wash detergent of claim 8 wherein said hard water control composition is present in an amount of from about 0.5 wt. % to about 15 wt. %.

15. The warewash detergent of claim 12 wherein said effective amount of polymer composition is such that said starch based polymer is present in an amount of about 45 ppm, with at least about 40 ppm maleic polymer and greater than 100 ppm active hydroxylcarboxylic acid.

16. The warewash detergent of claim 12 comprising from about 30 wt. % to about 50 wt % of the hardness control composition of claim 1, about 0.01 wt. % to about 10 wt. % of surfactant, and about 45 wt. % to about 60 wt. % of caustic with any remainder comprising water, or additional functional components.

17. A method of controlling water hardness in alkaline cleaning conditions comprising;

applying a water hardness controlling amount of the polymer composition of claim 1 to said alkaline cleaning conditions.

18. The method of claim 17 wherein said cleaning conditions include ware cleaning.

19. The method of claim 17 wherein said cleaning conditions include hard surface cleaning conditions.

20. The alkaline cleaning composition of claim 17 wherein said polymer composition is added simultaneous with an alkaline detergent.

* * * * *